US005588162A

United States Patent [19]

Robinson

[11] Patent Number: 5,588,162

[45] Date of Patent: Dec. 31, 1996

[54] POWER ACTUATED TOILET SEAT

[76] Inventor: Gary C. Robinson, P.O. Box 24, Cooter, Mo. 63839

[21] Appl. No.: 341,375

[22] Filed: Nov. 17, 1994

[51] Int. Cl.[6] ..... A47K 13/10; A47K 17/00

[52] U.S. Cl. ..... 4/667; 297/DIG. 10

[58] Field of Search ..... 4/246.1, 254, 248, 4/667, 483; 297/DIG. 10

[56] References Cited

U.S. PATENT DOCUMENTS

| | | | |
|---|---|---|---|
| 3,458,872 | 8/1969 | Hellstrom et al. | 297/DIG. 10 |
| 3,473,174 | 10/1969 | Cool | 4/254 |
| 4,587,678 | 5/1986 | Love et al. | 4/667 |
| 4,787,102 | 11/1988 | Rosenberg | 4/661 |
| 4,833,736 | 5/1989 | Sadler et al. | 4/667 |
| 4,884,841 | 12/1989 | Holley | 4/254 |
| 4,888,833 | 12/1989 | Garcia et al. | 4/667 |
| 5,163,188 | 11/1992 | Munroe | 4/483 |
| 5,189,739 | 3/1993 | Thierry | 4/254 |
| 5,309,583 | 5/1994 | White et al. | 4/667 |

*Primary Examiner*—Henry J. Recla
*Assistant Examiner*—Charles R. Eloshway
*Attorney, Agent, or Firm*—David L. Volk

[57] ABSTRACT

A power actuated toilet seat comprising a frame; a hinge mounted on the frame; a standard padded toilet seat connected at a forward end to the hinge; an actuator assembly in electrical communication with an external source of electricity and connected to a rear end of the toilet seat for raising and lowering the toilet seat; and a switch mounted to the frame and in electrical communication with the actuator assembly to permit the user to selectively raise and lower the toilet seat in response to manipulation of the switch.

2 Claims, 2 Drawing Sheets

POWER ACTUATED TOILET SEAT

BACKGROUND OF THE INVENTION

1. Field of the Invention

The present invention relates generally to devices for assisting infirm or injured individuals to move from a standing position to a sitting position and from a sitting position to a standing position. More particularly, the instant invention is directed to a toilet seat which is configured to assist infirm individuals in lowering themselves to and raising themselves from the sitting position.

2. Description of the Prior Art

Numerous innovations for a toilet seat utilizing actuating means for raising and lowering the toilet seat have been provided in the prior art that are described as follows. Even though these innovations may be suitable for the specific individual purposes to which they address, they differ from the present invention as hereinafter contrasted.

The patent literature includes numerous arrangements for assisting infirm individuals in sitting down and standing up from a chair or toilet seat. U.S. Pat. No. 4,538,853 discloses a chair with a resilient mechanism for assisting an occupant in raising him- or herself to a standing position. The chair is provided with a seat cushion which pivots relative to the chair frame about an axis near the rearward edge of the frame. The movement also serves to at least simultaneously partially elevate an armrest. When the chair is occupied, resilient struts are compressed to store energy for lifting the occupant. The seat may be manually locked in its lowered position.

U.S. Pat. No. 3,975,051 discloses an orthopedic chair which includes a movably supported frame assembly which serves to maintain a forwardly and downwardly extending saddle-shaped seat at a desired elevation between a pair of laterally spaced sidewalls and a backrest. The chair of this patent utilizes footrests and relies on electricity for its operation. U.S. Pat. No. 3,473,174 discloses a power-driven, tilted seat in which the seat and associated armrests are fixed relative to one another and move with respect to a supporting frame. Power-actuated hydraulic cylinders are used to raise and lower the seat. U.S. Pat. No. 4,587,678 to Love also relies on an electrically driven hydraulic lift. However, in this patent, the armrests are fixed with respect to the frame, and only the seat moves.

U.S. Pat. No. 4,907,303 discloses an orthopedic chair with a spring-loaded seat, wherein a coil spring is tensioned as a user sits in the seat in order to store energy where it is subsequently used to assist in lifting the user to his or her feet when he or she wishes to stand. A hand brake grips a cable attached to the spring to control application of the spring's force to the seat.

A toilet seat lifting apparatus comprising two side-by-side pivotally connected flat members, a first member having two spaced holes for alignment with seat attachment holes in a rear portion of a toilet bowl, and a second member extending from the first member in a forward direction toward the front of the toilet bowl having a projection at its forward end for engagement with a toilet seat. The second member further includes a lever extending rearwardly past the first member. This assembly is operated by a foot operated actuating member mounted adjacent a side of the toilet bowl with a connection between the lever and the actuating member. Upon installation of the members beneath a toilet seat, operation of the actuating member pulls the lever down and forward, causing the second member to pivot up to lift the seat. This assembly further consists of a resilient restraint connected to a lower surface of the second member and above a top surface of the toilet bowl for restraining downward movement of the second member With respect to the top surface of a toilet bowl.

The present invention differs from the above described patented invention in that the present invention includes a power actuated toilet seat comprising a frame constructed of one inch square stainless steel tubing; a hinge mounted on the frame; a standard padded toilet seat connected a forward end to the hinge; an actuator assembly connected to a rear end of the toilet seat for raising and lowering the toilet seat; and a switch mounted to the frame and in electrical communication with the actuator assembly to permit the user to selectively raise and lower the toilet seat in response to manipulation of the switch; functioning to assist the user in moving between a standing and a sitting position about a toilet.

A lift seat includes a seating surface, for example, a toilet seat, mounted on a supporting frame by a four-bar linkage. The four-bar linkage includes a lower link fixed to the frame and an upper link fixed to the seat. An armrest is attached to a front link of the four-bar linkage for pivoting therewith against the bias of the spring which loads the four-bar linkage as the seat is lowered from a raised position to a seating position. Energy stored in the spring is then available to lift the person from the seating position back to the raised position. A damper is connected to the four-bar linkage to prevent abrupt movement of the seat as the four-bar mechanism collapses and expands, while a gas spring is provided to initially resist movement of the four-bar linkage from either the expanded or the collapsed condition unless the armrest is initially rotated.

The present invention differs from the above described patented invention in that the present invention includes a power actuated toilet seat comprising a frame constructed of one inch square stainless steel tubing; a hinge mounted on the frame; a standard padded toilet seat connected a forward end to the hinge; an actuator assembly connected to a rear end of the toilet seat for raising and lowering the toilet seat; and a switch mounted to the frame and in electrical communication with the actuator assembly to permit the user to selectively raise and lower the toilet seat in response to manipulation of the switch; functioning to assist the user in moving between a standing and a sitting position about a toilet.

An automatic toilet seat device which Will cause a toilet seat to be either raised or lowered at the push of a single button and further, will automatically lower the toilet seat after the flush action of the toilet. A first switch associated with the device will, when activated, cause the toilet seat to be raised by an electric motor. Once the toilet user has flushed the toilet, a float switch associated with a tank of the toilet will cause the motor to lower the toilet seat. The control circuit controlling the automatic toilet seat device is microprocessor controlled and includes an over-current detection circuit. The over-current detection circuit will detect over-current in the motor when the seat is completely raised or lowered such that the microprocessor will stop the motor from turning.

The present invention differs from the above described patented invention in that the present invention includes a power actuated toilet seat comprising a frame constructed of one inch square stainless steel tubing; a hinge mounted on the frame; a standard padded toilet seat connected a forward end to the hinge; an actuator assembly connected to a,rear end of the toilet seat for raising and lowering the toilet seat; and a switch mounted to the frame and in electrical communication with the actuator assembly to permit the user to selectively raise and lower the toilet seat in response to manipulation of the switch; functioning to assist the user in moving between a standing and a sitting position about a toilet.

A movable toilet seat, the seat portion of which remains horizontal while raising and lowering. An upper frame capable of having a common toilet seat attached raises and lowers with respect to a lower frame. The lower frame provides support for the upper frame and is ached to the toilet. When the upper frame is raised, it also travels forward to allow more clearance from the toilet for the user. When the upper frame is lowered, it travels back to situate the user directly over the toilet bowl. Preferably, a reversible motor is used to raise and lower the upper frame. However, alternative embodiments encompass the use of an air shock absorber and a manual jack.

The present invention differs from the above described patented invention in that the present invention includes a power actuated toilet seat comprising a frame constructed of one inch square stainless steel tubing; a hinge mounted on the frame; a standard padded toilet seat connected a forward end to the hinge; an actuator assembly connected to a rear end of the toilet seat for raising and lowering the toilet seat; and a switch mounted to the frame and in electrical communication with the actuator assembly to permit the user to selectively raise and lower the toilet seat in response to manipulation of the switch; functioning to assist the user in moving between a standing and a sitting position about a toilet.

Numerous innovations for the toilet seal device have been provided in the prior art that are adapted to be used. Even though these innovations may be suitable for the specific individual purposes to which they address, they would not be suitable for the purposes of the present invention as heretofore described.

SUMMARY OF THE INVENTION

The power actuated toilet seat construe ted in accordance with the present invention differs from the above described patented invention in that the present inventions includes a power actuated toilet seat comprising a frame constructed of one inch square stainless steel tubing; a hinge mounted on the frame; a standard padded toilet seat connected at a forward end to the hinge; an actuator assembly connected to a rear end of the toilet seat for raising and lowering the toilet seat; and a switch mounted to the frame and in electrical communication with the actuator assembly to permit the user to selectively raise and lower the toilet seat in response to manipulation of the switch; functioning to assist the user in moving between a standing and a sitting position about a toilet.

It is a principal object of the present invention to overcome the above disadvantages by providing an toilet seat raising and lowering apparatus for assisting the user in moving between a standing position and a sitting position.

More specifically, it is an object of the present invention to provide a power actuated toilet seat which can be actuated by simply pushing a button.

Other objects of the present invention will in part be obvious and will in part appear hereinafter.

The invention accordingly comprises a power actuated toilet seat, its components, parts and their interrelationships, the scope of which will be indicated in the appended claims.

Readers will find further objects and advantages of the invention from a consideration of the ensuing description and the accompanying drawings.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

DETAILED DESCRIPTION OF THE PREFERRED EMBODIMENT

Figure 1:
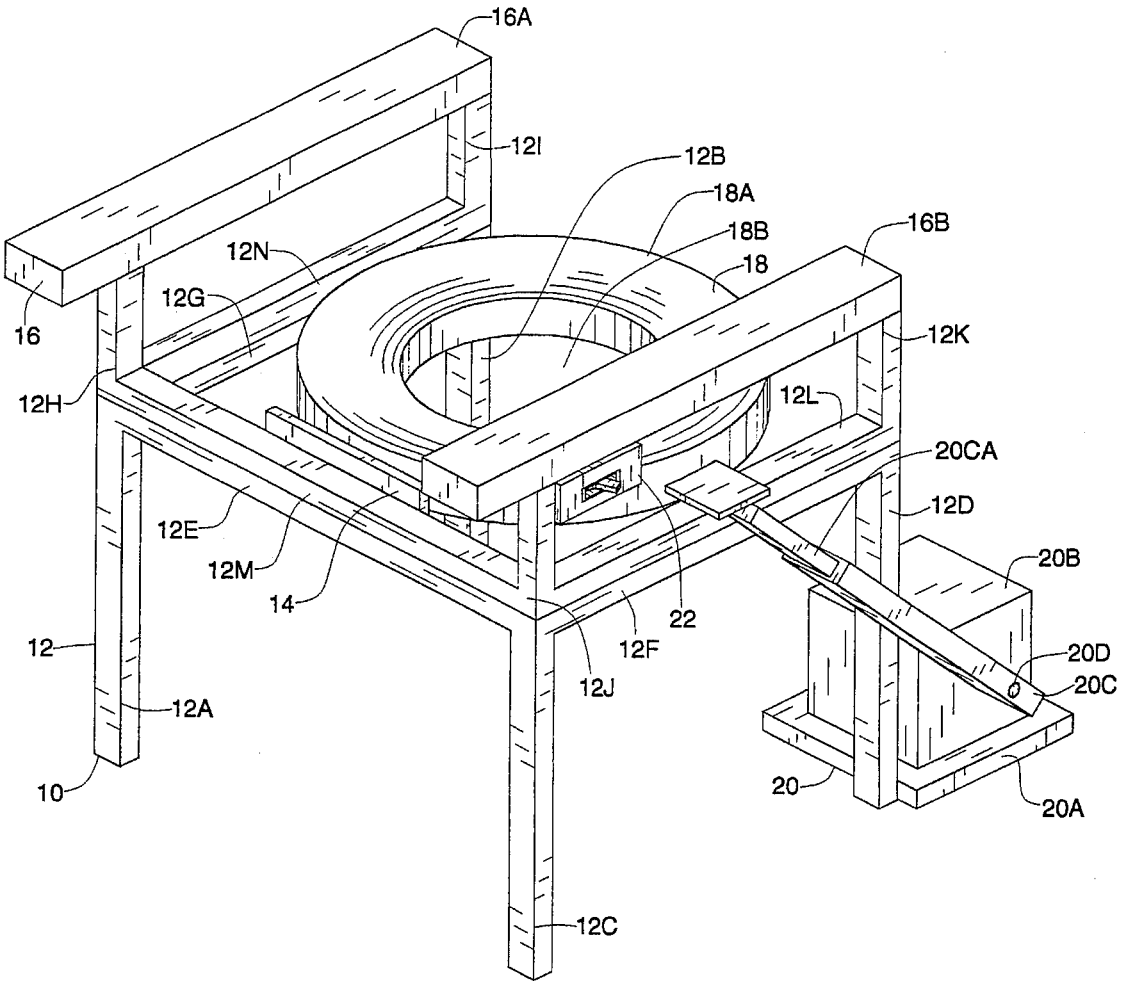
FIG. 1 is a perspective view of a power actuated toilet seat constructed in accordance with a preferred embodiment of the present invention with the toilet seat in the DOWN position.
Figure 2:
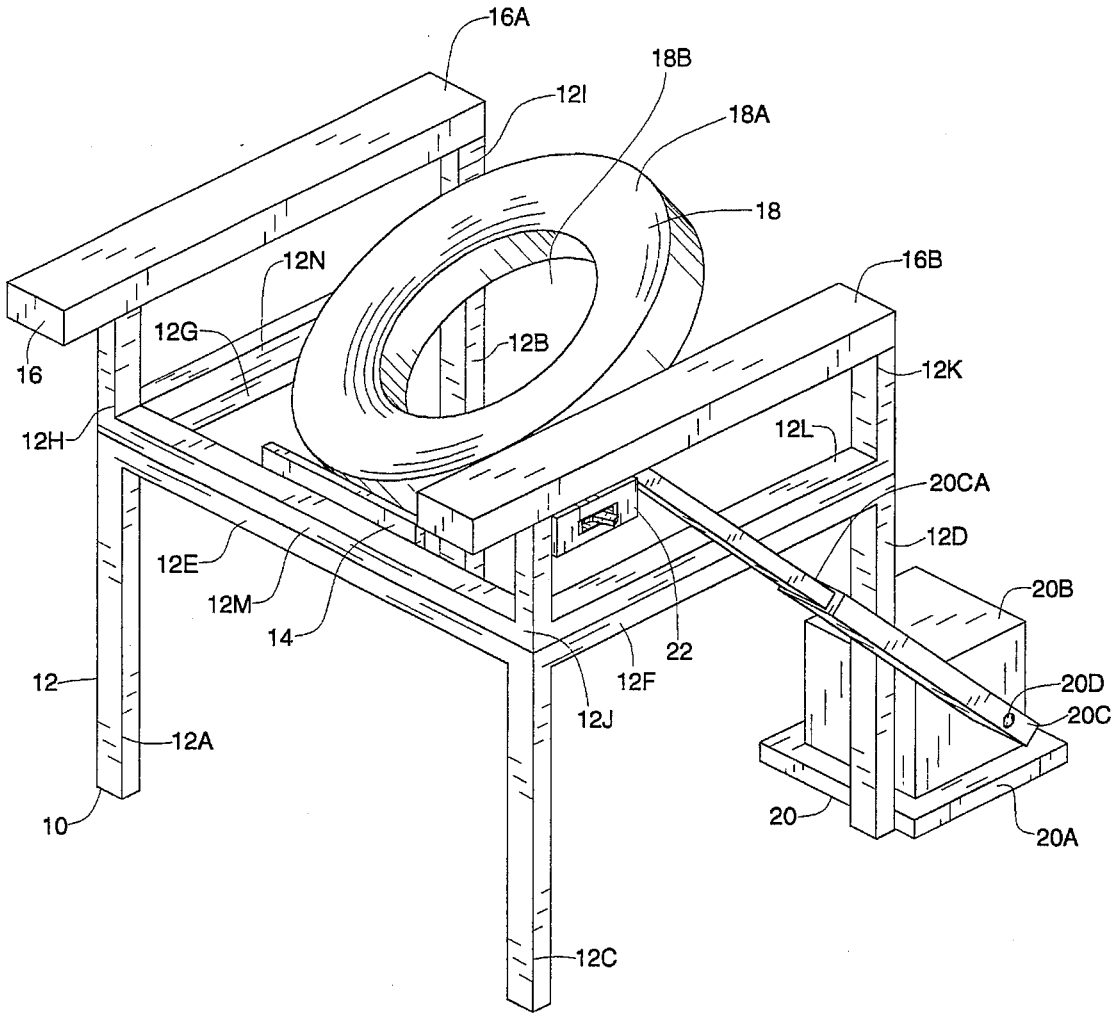
FIG. 2 is a view similar to that of FIG. 1 with the toilet seat in the UP position.

Referring to FIGS. 1 and 2 which are perspective views of a power actuated toilet seat constructed in accordance with a preferred embodiment of the present invention in a DOWN position, and an UP position, respectively, exhibiting the following features: power actuated toilet seat 10 comprising: a frame 12 constructed of one inch square stainless steel tubing; a hinge 14 mounted on the frame 12; a standard padded toilet seat 18 connected a forward end to the hinge 14; an actuator assembly 20 connected to a rear end of the toilet seat 18 for raising and lowering the toilet seat 18; and a switch 22 mounted to the frame 12 and in electrical communication with the actuator assembly 20 to permit the user to selectively raise and lower the toilet seat 18 in response to manipulation of the switch 22; functioning to assist the user in moving between a standing and a sitting position about a toilet; frame 12 constructed of one inch square stainless steel tubing and having a frame front right leg 12A connected at one end to a frame front lower cross bar 12E and a frame right lower cross bar 12G, a frame rear right leg 12B connected at one end to the frame right lower cross bar 12G, a frame front left leg 12C connected at one end to the frame front lower cross bar 12E and a frame left lower cross bar 12F, a frame rear left leg 12D Connected at one end to the frame left lower cross bar 12F, a frame right lower cross bar 12G, a frame front right arm support 12H connected at a lower end to a frame front upper cross bar 12M and a frame right upper cross bar 12N and at an upper end to a right arm rest 16A, a frame rear right arm support 12I connected at a lower end to the frame right upper cross bar 12N and at an upper end to the right arm rest 16A, a frame front left arm support 12J connected at a lower end to the frame front upper cross bar 12M and a frame left upper cross bar 12L and at an upper end to a left arm rest 16B, and a frame rear left arm support 12K connected at a lower end to the frame rear left leg 12D and at an upper end to the left arm rest 16B, functioning to support power actuated toilet seat 10; frame front right leg 12A connected at one end to the frame front lower cross bar 12E and the frame right lower cross bar 12G, functioning to support frame 12; frame rear right leg 12B connected at one end to the frame right lower cross bar 12G, functioning to support frame 12; frame front left leg 12C connected at one end to the frame front lower cross bar 12E and the frame left lower cross bar 12F, functioning to support frame 12; frame rear left leg 12D connected at one end to the frame left lower cross bar 12F, functioning to support frame 12; frame front lower cross bar 12E mounted to the frame front upper cross bar 12M and connected at one end to the frame front right leg 12A and at another end to the frame front left leg 12C, functioning to support frame 12; frame left lower cross bar 12F mounted to the frame left upper cross bar 12L and connected at one end to the frame front left leg 12C and at another end to the frame rear left leg 12D, functioning to support frame 12; frame right lower cross bar 12G mounted to the frame right upper cross bar 12N and connected at one end to the frame front right leg 12A and at another end to the frame rear right leg 12B, functioning to support frame 12; frame front right arm support 12H connected at a lower end to the frame front upper cross bar 12M and the frame right upper cross bar 12N and at an upper end to the right arm rest 16A, functioning to support the right arm rest 16A; frame rear right arm support 12I connected at a lower end to the frame right upper cross bar 12N and at an upper end to the right arm rest 16A, functioning to support the right arm rest 16A; frame front left arm support 12J connected at a lower end to the frame front upper cross bar 12M and the frame left upper cross bar 12L and at an upper end to the left arm rest 16B, functioning to support the left arm rest 16B; frame rear left arm support 12K connected at a lower end to the frame rear left leg 12D and at an upper end to the left arm rest 16B, functioning to support the left arm rest 16B; frame left upper cross bar 12L mounted to the frame left lower cross bar 12F and connected at one end to the frame front left arm support 12J and at another end to the frame rear left arm support 12K, functioning to support frame 12; frame front upper cross bar 12M mounted to the frame front lower cross bar 12E and connected at one end to the frame front right arm support 12H and at another end to the frame front left arm support 12J, frame front upper cross bar 12M further having hinge 14 mounted thereon, functioning to support frame 12; frame right upper cross bar 12N mounted to the frame right lower cross bar 12G and connected at one end to the frame front right arm support 12H and at another end to the frame rear right arm support 12I, functioning to support frame 12; hinge 14 mounted on frame front upper cross bar 12M and connected to a toilet seat 18, functioning to permit pivotal movement of the toilet seat 18 about the frame 12; right arm rest 16A mounted on the frame front right arm support 12H and the frame rear: right arm support 12I, functioning to aid the user in moving between a standing position and a sitting position; left arm rest 16B mounted on the frame front left arm support 12J and the frame rear left arm support 12K, functioning to aid the user in moving between a standing position and a sitting position; toilet seat 18 connected to hinge 14 and having a toilet seat padded upper surface 18A and defining a toilet seat bore 18B, functioning to support the user thereon; toilet seat padded upper surface 18A functioning to comfortably support the user thereon; toilet seat bore 18B through which waste passes from the user; actuator assembly 20 disposed adjacent frame 12 and having an actuator assembly base 20A, an actuator assembly housing 20B mounted on the actuator assembly base 20A, and an actuator assembly actuating arm 20C extending from the actuator assembly housing 20B and connected to the toilet seat 18, the actuator assembly 20 in electrical communication with a switch 22, functioning to move toilet seat 18 between an UP position and a DOWN position in response to manipulation of switch 22 by the user; actuator assembly base 20A having the actuator assembly housing 20B mounted thereon, functioning to support the actuator assembly 20; actuator assembly housing 20B mounted on the actuator assembly base 20A and having the actuator assembly actuating arm 20C extending therefrom, functioning to move an actuator assembly actuating arm extension 20CA; actuator assembly actuating arm 20C extending from the actuator assembly housing 20B and having the actuator assembly actuating arm extension 20CA movably secured thereto, functioning to support the actuator assembly actuating arm extension 20CA; actuator assembly actuating arm extension 20CA movably secured to the actuator assembly actuating arm 20C and connected to the toilet seat 18, functioning to be extended and retracted by the actuator assembly 20 to move the toilet seat 18 between the UP position and the DOWN position; and switch 22 mounted to the frame 12 and in electrical communication with the actuator assembly 20 to permit the user to selectively raise and lower the toilet seat 18 in response to manipulation of the switch 22.

It will be understood that each of the elements described above, or two or more together, may also find a useful application in other types of constructions differing from the type described above.

While the invention has been illustrated and described as embodied in a power actuated toilet seat, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is desired to be protected by Letters Patent is set forth in the appended claims.

I claim:

1. A toilet seat assembly comprising:

a frame including a plurality of legs rigidly connected to each other by a plurality of cross members, said cross members including an upper cross bar abutting and located above a lower cross bar;

b. a hinge mounted on the upper cross bar;

c. a toilet seat connected at a forward end thereof to the hinge, thereby permitting pivotal movement of the toilet seat about the upper cross bar;

d. an actuator assembly connected to the, toilet seat for raising and lowering the toilet seat, the actuator assembly configured for electrical operation; and e. a switch mounted to the frame and in electrical communication with the actuator assembly to permit a user to selectively raise and lower the toilet seat in response to manipulation of the switch, whereby the toilet seat assembly functions to assist such a user in moving between a standing and a sitting position about a toilet.

2. A toilet seat assembly comprising:

a. a frame constructed of one inch square stainless steel tubing and having a frame front right leg connected at one end to a frame front lower cross bar and a frame right lower cross bar, a frame rear right leg connected at one end to the frame right lower cross bar, a frame front left leg connected at one end to the frame front lower cross bar and a frame left lower cross bar, a frame rear left leg connected at one end to the frame left lower cross bar, a frame front right arm support connected at a lower end to a frame front upper cross bar and a frame right upper cross bar and at an upper end to a right arm rest;

b. the frame further including a frame rear right arm support connected at a lower end to the frame right upper cross bar and at an upper end to the right arm rest, a frame front left arm support connected at a lower end to the frame front upper cross bar and a frame left upper cross bar and at an upper end to a left arm rest, and a frame rear left arm support connected at a lower end to the frame rear left leg and at an upper end to the left arm rest;

c. the frame front right leg connected at one end to the frame front lower cross bar and the frame right lower cross bar, functioning to support the frame, the frame rear right leg connected at one end to the frame right lower cross bar, functioning to support the frame;

d. the frame front left leg connected at one end to the frame front lower cross bar and the frame left lower cross bar, functioning to support the frame, the frame rear left leg connected at one end to the frame left lower cross bar, functioning to support the frame;

e. the frame front lower cross bar mounted to the frame front upper cross bar, and connected at one end to the frame front right leg and at another end to the frame front left leg, functioning to support the frame, the frame left lower cross bar mounted to the frame left upper cross bar and connected at one end to the frame front left leg and at a another end to the frame rear left leg, functioning to support the frame;

f. the frame right lower cross bar mounted to the frame right upper cross bar and connected at one end to the frame front right leg and at another end to the frame rear right leg, functioning to support the frame, the frame front right arm support connected at a lower end to the frame front upper cross bar and the frame right upper cross bar and at an upper end to the right arm rest, functioning to support the right arm rest, the frame rear right arm support connected at a lower end to the frame right upper cross bar and at an upper end to the right arm rest, functioning to support the right arm rest, the frame front left arm support connected at a lower end to the frame front upper cross bar and the frame left upper cross bar and at an upper end to the left arm rest, functioning to support the left arm rest;

g. the frame rear left arm support connected at a lower end to the frame rear left leg and at an upper end to the left arm rest, functioning to support the left arm rest, the frame left upper cross bar mounted to the frame left lower cross bar and connected at one end to the frame front left arm support and at another end to the frame rear left arm support, functioning to support the frame, the frame front upper cross bar mounted to the frame front lower cross bar and connected at one end to the frame front right arm support and a another end to the frame front left arm support, the frame front upper cross bar functioning to support the frame;

h. the frame right upper cross bar mounted to the frame right lower cross bar and connected at one end to the frame front right arm support and at another end to the frame rear right arm support, functioning to support the frame;

i. a hinge mounted on the frame front upper cross bar and connected to a forward end of a padded toilet seat, functioning to permit pivotal movement of the toilet seat about the frame;

j. an actuator assembly configured for electrical operation, the actuator assembly connected to the toilet seat for raising and lowering the toilet seat; and k. a switch mounted to the frame and in electrical communication with the actuator assembly to permit a user to selectively raise and lower the toilet seat in response to manipulation of the switch, whereby the toilet seat assembly functions to assist such a user in moving between a standing and a sitting position about a toilet.

* * * * *